United States Patent [19]

Blowsky

[11] 3,970,297

[45] July 20, 1976

[54] SHEET WITHDRAWING MECHANISM AND ITS COMBINATION WITH A COLLATOR

[75] Inventor: Frank C. Blowsky, Flushing, N.Y.

[73] Assignee: Luis Mestre Development Corporation, Long Island City, N.Y.

[22] Filed: Oct. 29, 1973

[21] Appl. No.: 410,900

[52] U.S. Cl. ..... 270/58

[51] Int. Cl.[2] ..... B65H 39/045

[58] Field of Search ..... 270/12, 45, 51, 52, 270/58; 271/9, 120

[56] References Cited

UNITED STATES PATENTS

| | | | |
|---|---|---|---|
| 763,159 | 6/1904 | Cross | 271/120 |
| 2,089,861 | 8/1937 | Schlensker | 270/58 |
| 2,235,844 | 3/1941 | Nelson | 271/120 |
| 2,455,836 | 12/1948 | Brummelen | 271/120 |
| 2,940,750 | 6/1960 | Mestre | 270/58 |

*Primary Examiner*—Edgar S. Burr
*Assistant Examiner*—A. Heinz
*Attorney, Agent, or Firm*—John M. Montstream

[57] ABSTRACT

A sheet withdrawing mechanism is disclosed for a collator having a plurality of spaced moving shelves or partitions forming pockets. Each partition or pocket receives a pile of sheets and as each pocket passes sheet withdrawing position, rotating spiders, preferably having a plurality of arms, each extend an arm into each pocket in succession, engage the top sheet of the pile and at least partially withdraw the sheet far enough to be reached by adjacent secondary withdrawing mechanism which completes the withdrawal of the sheet from the pocket. Two constructions of spiders are illustrated and described, one having relatively long arms for partition spacing having a relatively large dimension so that the arc of movement of the end of each arm is great enough to withdraw the sheet sufficiently solely by the sweep of the arm. The second spider construction is for partition spacing having a relatively lesser dimension so that a greater number of pockets can be provided in an over-all dimension. This second spider has relatively shorter arms and has a withdrawal roll on the end of each arm which is rotated so that each sheet is partially withdrawn from its pocket by a combination of the sweep of the arm and the rotation of the withdrawal roll. Also included is mechanism to advance the phase of the spider arms with respect to the phase of the pockets as they rotate. Thus, the spider arms are advanced and enter the pockets progressively sooner.

41 Claims, 13 Drawing Figures

21
54
59
61
62
64
65
66
67
68
69
149
133
31a
30
31
32
33
34
35
36
37
38
39
42
43
44
45
46
48
51
52
55
121
122
137
139
140
146

SHEET WITHDRAWING MECHANISM AND ITS COMBINATION WITH A COLLATOR

BACKGROUND OF THE INVENTION

Collators having pockets which move relative to a sheet withdrawing or ejecting station have been widely used. One type of collator, shown in Mestre U.S. Pat. No. 2,940,750, uses clamping mechanisms on a conveyor to withdraw and transport sheets from sheet receiving pockets. This collator has a collating speed on the order of 25,000 sheets per hour.

Another collator, shown in Blowsky U.S. Pat. No. 3,540,721, is provided with feed rolls in sheet receiving pockets, formed in a drum, to eject the sheets from the pockets and has a collator speed of about 28,000 sheets per hour.

The sheet withdrawing mechanism of the invention is applicable to any form of collator having pockets, such as formed by spaced shelves or partitions, in which the pockets move past a sheet withdrawing or ejecting station. A plurality of the pockets are loaded with piles of sheets, the sheets in each pocket being the same and successive pockets being loaded with piles of sheets of different pages to complete a book. The sheet withdrawing mechanism uses spider means including at least one spider having a body and preferably a plurality of arms each carrying a friction member, which rotates in timed sequence to the movement of the pockets relative to the sheet withdrawing station so that each arm sweeps into and out of a pocket in succession. With the speed of the friction member greater than that of the pockets the friction member on the end of each arm engages the top sheet in the pile and at least partially withdraws it from the pocket. Adjacent secondary sheet withdrawing means may be provided to complete the withdrawal of the sheet from the pocket and deposit it in a pile on a deposit table.

An object of the invention is to construct a simple sheet withdrawing mechanism having at least one and preferably a plurality of outwardly extending resiliently biased arms which rotate and sequentially reach into pockets formed by movable and relatively closely spaced partitions. Sheets in the pockets are engaged by arms and withdrawn at least far enough to be received by adjacent secondary sheet withdrawing means which completes the withdrawal of the sheets from the pockets.

Another object is to construct a sheet withdrawing mechanism having outwardly extending arms with a rotating withdrawing roll on the end of each arm. Rotation of the roll adds to the sweep of the arm in at least partially withdrawing a sheet so that the partitions forming the pockets may be relatively closely spaced with the pockets of relatively small vertical dimensions, thereby enabling a larger number of pockets to be provided in a given overall dimension.

A further object is to construct sheet withdrawing mechanisms of the types described in combination with advancing means for the spider arms so that as the pile of sheets is reduced in height, the phase of the spider arm is advanced with respect to the phase of the pockets to accommodate for the reduction in height of the piles of sheets.

Another object is to construct a sheet withdrawing mechanism having a rotary spider which combines the structures of spider advancing means and a rotating withdrawing roll carried by the end of each arm of the spider.

A further object is to construct a combination of a collator having moving pockets with the sheet withdrawing mechanism for at least partially withdrawing a sheet from the top of a pile of sheets in each of a plurality of the pockets at a sheet withdrawing station, which mechanism utilizes a rotating spider preferably having a plurality of radially extending, resiliently biased arms. The spider rotates in timed sequence with the movement of the pockets so that each arm, in its rotation, enters its respective pockets and engages the top sheet of the pile of sheets therein to withdraw the top sheet from the pile sufficiently far to be received by adjacent secondary withdrawal means which completes the withdrawal of the sheet from each pocket.

Other objects of the invention will be more apparent when the following description is read in connection with the figures of the accompanying drawings.

FIG. 7A is a section taken on line *7a—7a* of FIG. 7;

Figure 1:
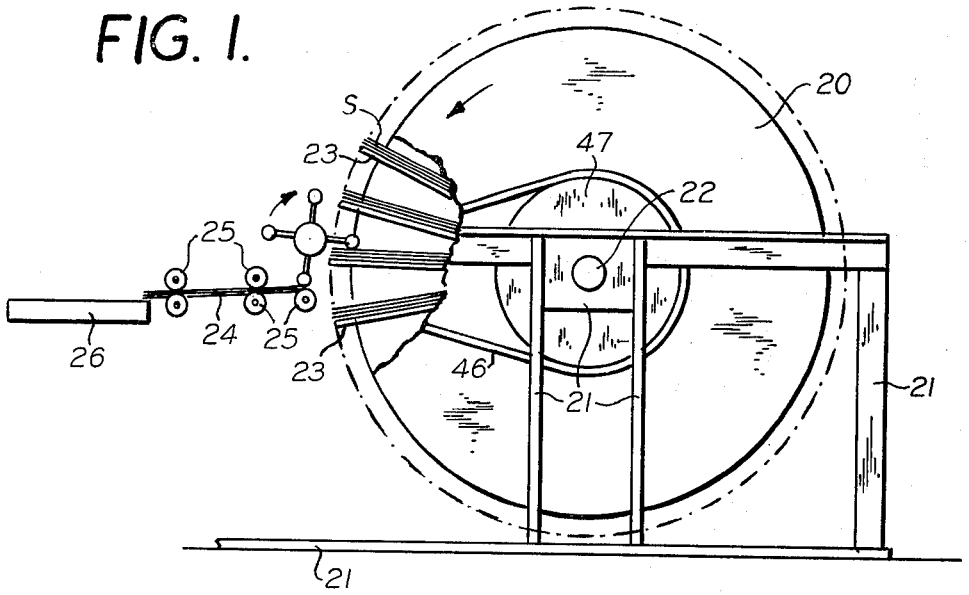
FIG. 1 is a side view of a rotating drum type of collator with sheet withdrawing mechanism.

The sheet withdrawing or ejecting mechanism, FIG. 1, is shown as applied to a rotary drum type of collator, as illustrative of any form of collator, in which pockets move past a sheet withdrawing station. The rotary drum collator uses a drum 20 mounted on a main frame 21 for rotation. The drum is secured to a shaft 22 and has a plurality of radially extending spaced partitions or shelves 23 forming pockets therebetween with peripheral openings. The pockets move past a sheet withdrawing station illustrated by a delivery table 24.

In operation, a pile of sheets S is placed in a plurality of the pockets and the sheet withdrawing means withdraws the top sheet from each pile in each pocket at the withdrawing station far enough so that suitable secondary withdrawing means 25, part of which is under or adjacent to the sheet withdrawing mechanism, receives each sheet and passes it over the table 24 to complete the withdrawal of each sheet. The secondary withdrawal means is illustrated generally as including rollers 25 which may be suitably connected with and driven by a common driving mechanism. Each sheet is deposited in a pile on a deposit table 26. With a different page of a book in successive pockets, complete books are assembled on the deposit table, which moves downwardly by known means as the sheets are deposited thereon.

Figure 9:
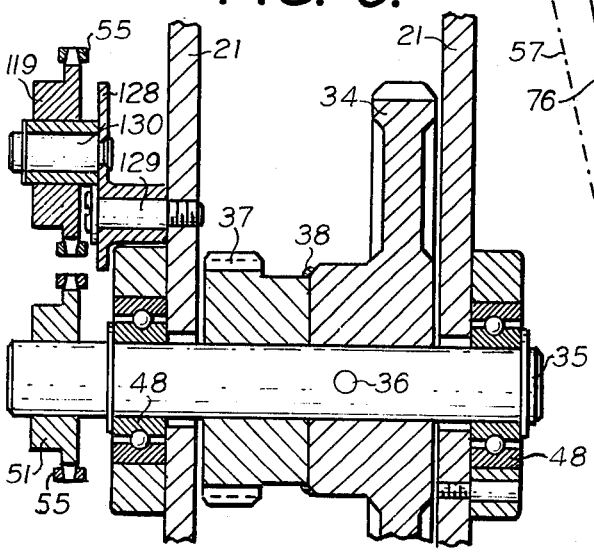
FIG. 9 is a section taken on line 9—9 of FIG. 7.

A common driving mechanism rotates the drum and drives the sheets withdrawing mechanism so that both the pockets and the sheet withdrawing mechanism turn in timed sequence with respect to each other. The driving mechanism, FIGS. 2 and 7, includes a motor driven pulley 30 secured to a main or first shaft 31 on which a pinion 32 is secured by a pin 33. A hand wheel 31*a* on the shaft 31 permits manual operation. The pinion meshes with a gear 34 secured to a second shaft 35 by a pin 36. The gear 34 is secured to a second pinion 37 by a weldment 38 and this pinion meshes with a gear 39 secured to third shaft 42. The third shaft has a driving connection with the drum 20 shown as a sprocket 43 secured to the third shaft by a pin 44. The sprocket is secured to the gear 39 by a weldment 45. A chain 46 meshes with this sprocket and a drum sprocket 47, FIG. 1, secured to the drum shaft. The shafts are mounted on the main frame by suitable bearings 48 (FIG. 9).

Figure 7:
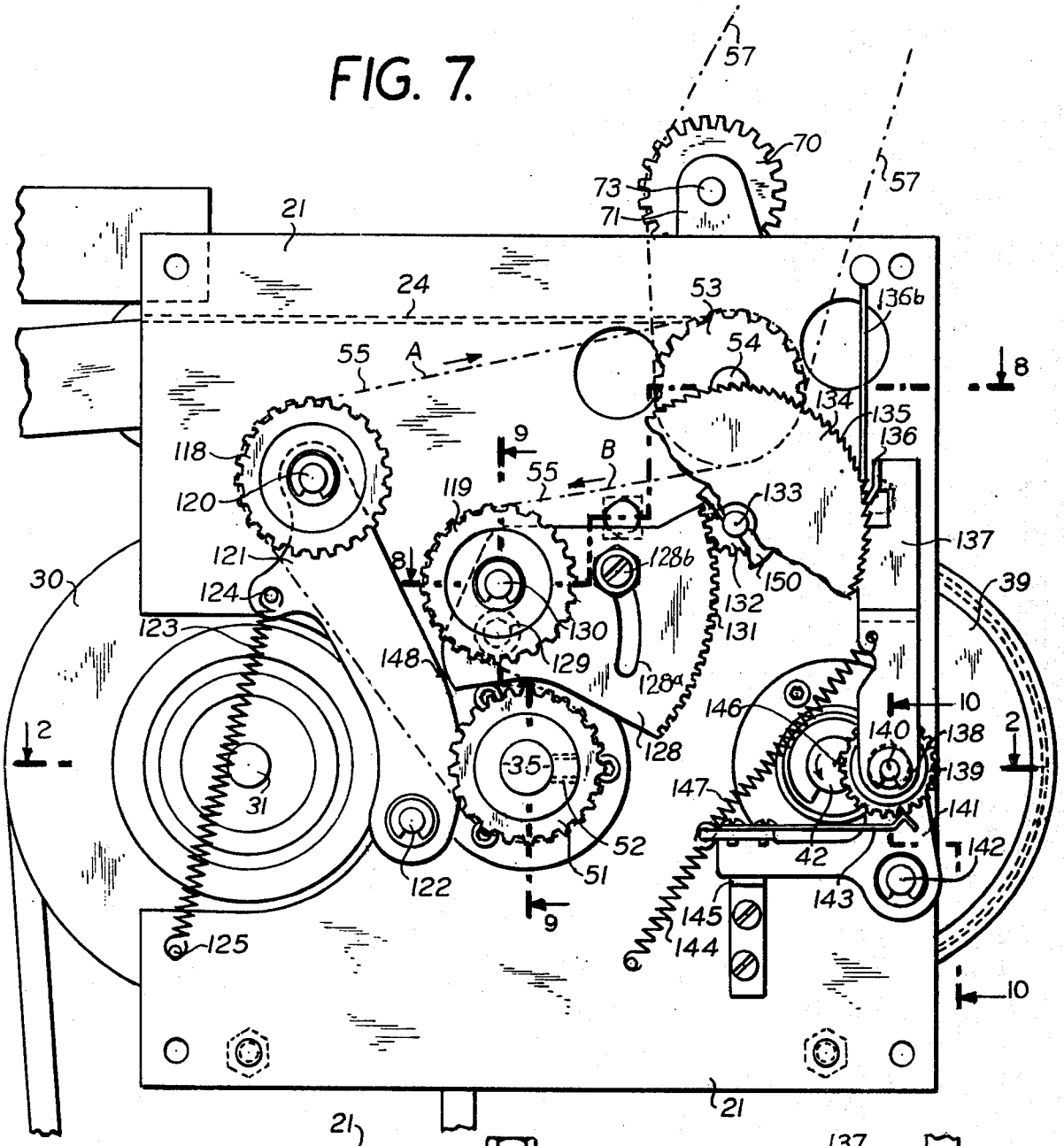
FIG. 7 is a front view of phase advancing means for the spider.
Figure 8:
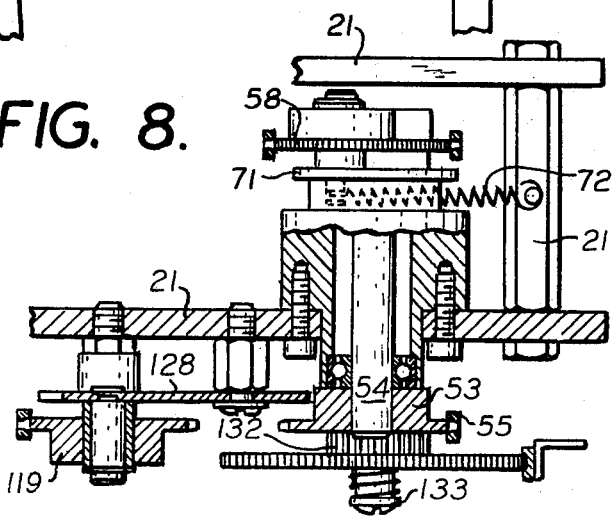
FIG. 8 is a section taken on line 8—8 of FIG. 7.

The second shaft 35 has a driving connection with the spider means which includes a driving wheel 51, shown as a sprocket secured to the shaft by a screw 52, and a driven wheel 53, shown as a sprocket, FIG. 7, secured to a stub shaft 54 (FIG. 8). The sprockets are operatively connected by a chain 55. The stub shaft 54 has another sprocket 56 (FIG. 3) secured thereto, which sprocket is connected by a chain 57 with a sprocket 58 secured to a spider shaft 59. Spider means, preferably a pair of spiders 75 are secured to the spider shaft by a key 60 and rotated by this shaft. The drum and spider means are connected with and driven from the same shaft 35, and rotate in timed relation with respect to each other so that each arm of the spider means will enter a pocket of the drum at the proper time to withdraw a sheet therefrom. The chain 55 is longer than necessary to operatively connect the sprockets 51 and 53 as will appear more fully hereinafter.

The sheet withdrawing mechanism includes the spider or spiders 75 mounted on the spider shaft 59. The key 60 rotates the spider means and permits each spider to be adjusted along the shaft. When two spiders 75 are provided, they are spaced apart and adjustable axially on the spider shaft 59 to accommodate for different widths of sheets.

It is also desirable for the spiders to be movable toward and away from operative position adjacent to the collator. This is accomplished by mounting the spider shaft 59 on a mounting frame, shown as a pivotal frame formed by a pair of spaced carrier arms 61, FIGS. 3, 5, and 11, each of which is pivoted on the shaft 54. A handle 62 may be provided on one arm to manually shift the position of the spiders 75.

Figure 3:
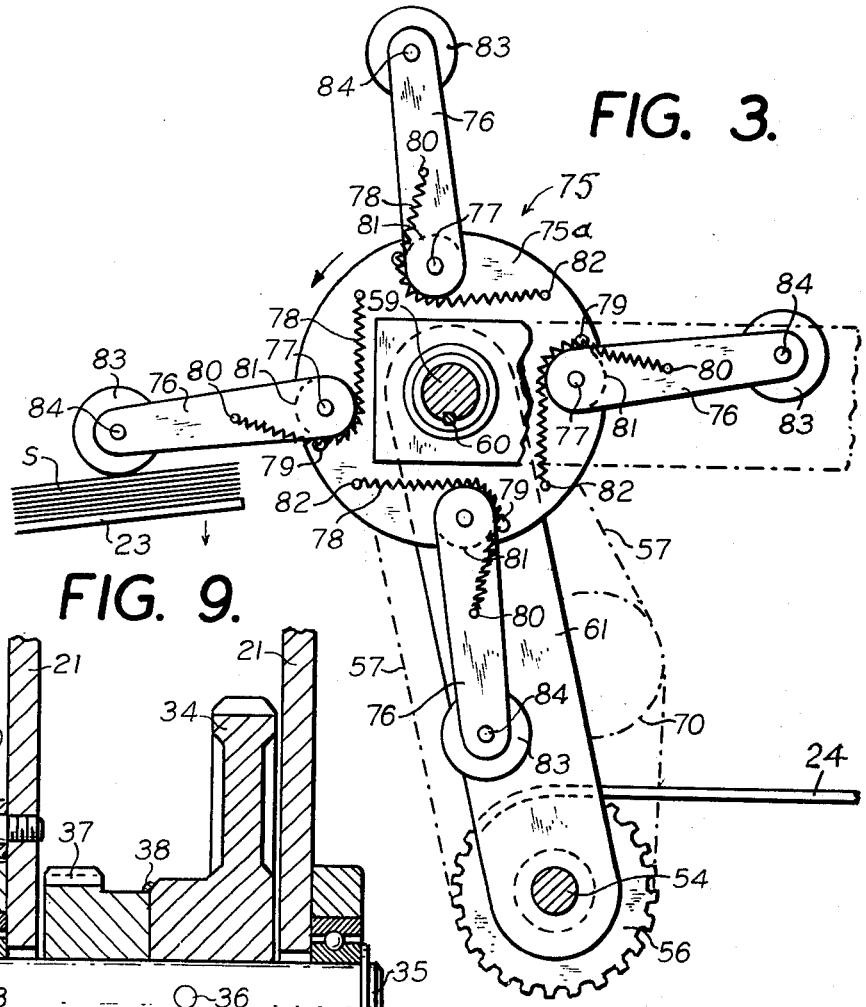
FIG. 3 is a side view of one form of spider for partially withdrawing a sheet from a pocket.
Figure 4:
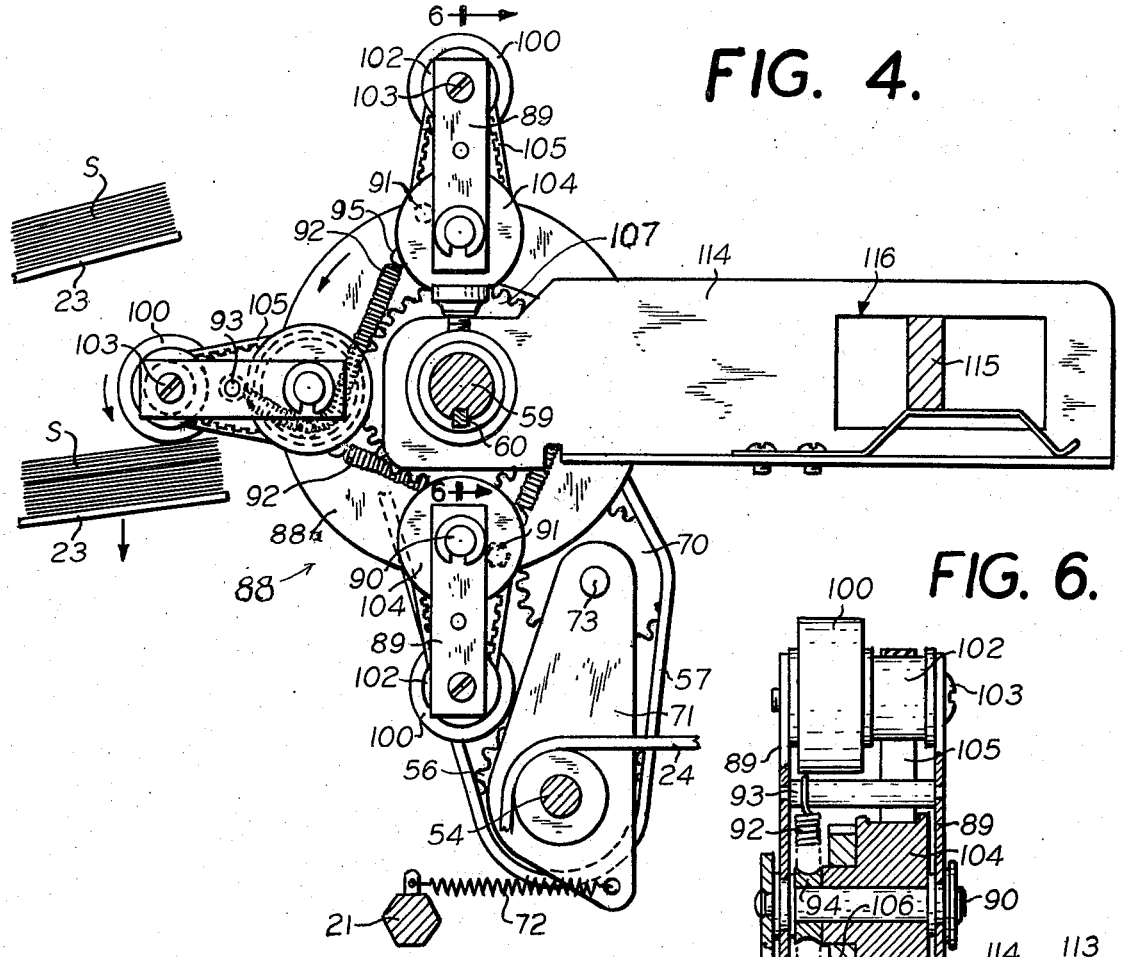
FIG. 4 is a side view taken on line 4—4 of FIG. 5 of a form of sheet withdrawing mechanism having a rotating sheet withdrawing roll on the end of each arm.

Retaining means yieldably, hold the spider in operative position, and preferably in two positions, namely, operative position adjacent to the moving collator pockets and retracted position away from the drum. This means includes a releasable catch 64, FIG. 11, pivotally mounted on the frame 21 by a pin 65 and having a notch 66 engaging a catch pin 67 to retain the spiders in operative position and a second adjustment notch 68 to receive the catch pin 67 and retain the spider in retracted position. A spring 69 urges the catch downwardly so that should there be a jam or mistiming of the spider, it can be forced rearwardly to retracted position with the pin 67 in notch 68. An idler sprocket 70, FIG. 3 and 4, is mounted on a pin 73 carried by an idler arm 71 which is pivotally mounted on the shaft 54. A spring 72 having one end attached to the arm and the other end attached to the frame keeps the chain 57 taut.

There are two constructions of spiders illustrated, one in FIG. 3 and the other in FIG. 4. The spider 75 of FIG. 3 is a simpler form and has a spider body, including a frame 75*a* shown as a plate, which carries at least one, but preferably a plurality of, circumferentially spaced spider arms 76, each pivotally mounted on a pin 77 and extending radially or substantially radially outwardly from the spider body. A spider with four arms is particularly shown. To resiliently bias each of the arms to their outward position, an arm spring 78 urges each arm against a stop 79 located so that the arm normally projects outwardly. This pivotal construction enables the arms to adjust themselves to varying pile thickness as well as to yield if obstructed.

One end of the arm spring 78 is fixed to the arm on a pin 80, the spring then bending around the pivot or a collar 81 therefor and the other end is fixed to a pin 82 on the spider frame. This construction provides a long and hence soft spring so that the arm may yield for varying pile thickness and yield rearwardly as much as 90 degrees if this should become necessary because of some malfunction.

The end of each spider arm carries a friction member 83 which may be in the form of a fixed or semi-fixed roll, typically formed of or surfaced by rubber or the like, secured to the end of the arm on a pin 84. A semi-fixed roll is one which is free to turn in one direction on projection of the friction member into the pocket or roll inwardly, but is fixed or non-rotatable in the other direction on its outward movement. The friction member engages the top sheet of the pile of sheets S in its pocket, pivots the arm from its outwardly extending position away from its stop 79 so that spring pressure is applied to the sheet, and withdraws the sheet by the sweep of the arm far enough to have the leading edge of the sheet projected into the secondary withdrawing means or rolls 25. The secondary withdrawing means then completes the withdrawal of the sheet from the pocket and deposits the sheet on the pile on the deposit table 26. When the vertical opening of a pocket is relatively large, roughly about 5.4 inches, such as the opening provided by a drum having a diameter at the outer ends of the partitions of about 51¼ inches and 30 partitions, the spider of FIG. 3 with relatively long arms may be used.

Figure 6:
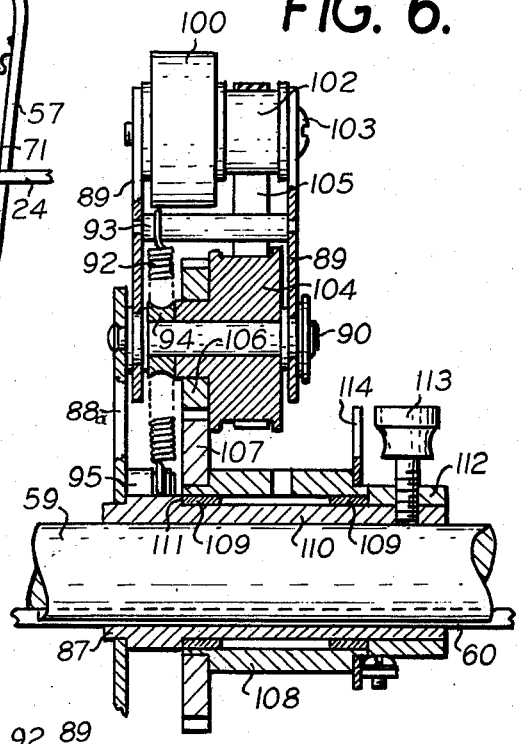
FIG. 6 is a section taken on line 6—6 of FIG. 4.
Figure 5:
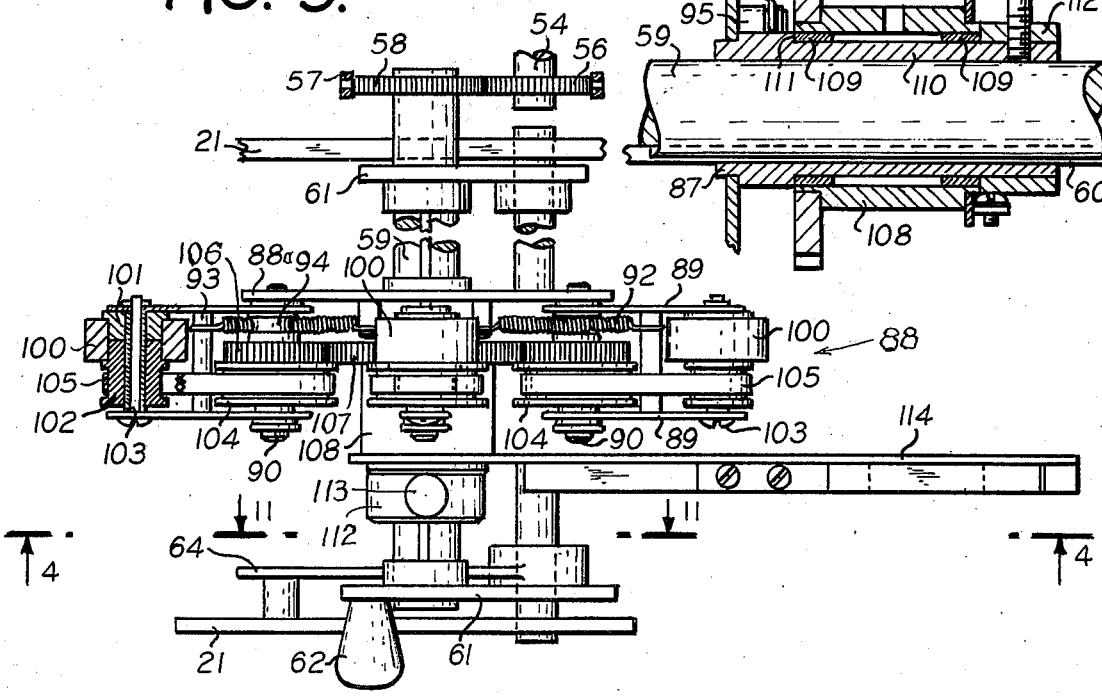
FIG. 5 is a top view of the sheet withdrawing mechanism of FIG. 4 with parts in section.

With the same diameter of drum but with 50 partitions 23, or pockets, around the periphery, the peripheral or vertical dimension of the pocket opening is about 3.2 inches. With this arrangement, the rotating spider arms of FIG. 3, with its relatively long arms, would not have enough room to enter the pockets and withdraw a sheet therefrom. This would apply to any form of collator in which the partition spacing is this, or roughly this, dimension. A spider 88, the preferred form of spider, shown in FIGS. 4–6, is used for partitions which are spaced apart about this dimension or for a 50 pocket collator drum of the same diameter as the 30 pocket drum. This spider has shorter arms, a rotatable withdrawing roll on the end of each arm, and means to rotate this withdrawing roll to add its rotation to the sweep of the arm to withdraw each sheet far enough to project the leading edge of the sheet into the secondary withdrawing means. The spider 88 has a spider body, including a frame 88*a* shown as a plate, secured to a hub 87 and carrying at least one arm but preferably having a plurality of arms 89, four arms equally spaced circumferentially being shown. Each arm, shown as a pair of spaced members, is pivotally mounted on a pivot 90. An arm stop 91 is carried by the spider frame 88*a* for each arm for retaining the associated arm in radially or substantially radially outwardly extending position. An arm spring 92 has one end fastened to its arm on a pin 93, the spring then passing around the pivot 90 on a collar 94 with the other end of the spring being fastened to a pin 95 spaced from the pivot so that a long and hence soft spring is provided to resiliently urge its arm against its stop. When the withdrawing roll engages the top sheet in the pile, the arm pivots away from the stop so that the roll presses against the sheet by the pressure of the spring.

A withdrawing or ejecting roll 100, FIGS. 4–6, typically provided with a rubber or like peripheral surface, as shown, is rotatably mounted on the end of each arm 89 and is rotated in the direction of rotation of the spider 88 or sheet withdrawing direction. The mounting shown includes a core 101 to which the withdrawing roll is secured. Suitable means are used to rotate the roll, that shown is a driven pulley 102, secured to or forming a part of the core, which is rotatable on a pin 103 carried by the arm 89. The arm pivot 90 has a driving pulley 104 mounted thereon and a drive belt 105 passes around these pulleys, which pulleys and belt are preferably of the cogged type. Pulleys 104 and 102 have a 2 to 1 ratio. Pulley 104 is driven by a gear 106 secured thereto which meshes with a stationary gear 107 carried by a sleeve 108. The bore of the sleeve has a pair of bushings 109 secured thereto which are received on a hub 110 so that a shoulder 111 adjacent one end and a second shoulder provided by an end collar 112 at the other end retains the sleeve on the hub whenever the spider 88 is moved axially on the drive shaft 59 to accommodate different widths of sheet to be collated. A screw 113 secures the collar to the hub and secures the hub and spider to the drive shaft 59 in adjusted position. The key 60 provides a driving connection between the shaft 59 and the spider means to rotate the same. The gear 107 may have 64 teeth and the gear 106 may have 30 teeth to provide an odd ratio so that the withdrawing roll 100 contacts sheets at different points on its periphery for a plurality of spider revolutions to even wear on the rolls. The withdrawing roll rotates about four revolutions for each revolution of the spider which supplies sufficient withdrawing motion, in addition to the sweep of the roll, to withdraw the sheet far enough to reach the secondary withdrawing means 25.

A holding bracket 114 is secured to the sleeve 108 and is anchored to adjacent fixed structure, such as by a main frame bar 115 received in a slot 116, to hold the sleeve, and hence the gear 107, stationary. The gears 106 meshing with the stationary gear 107, and rotating with the spider, rotate the gears 106 and the withdrawing rolls 100.

Preferably two spiders 88 are used spaced apart and adjustable axially on the spider shaft to accommodate different widths of sheets.

To provide engagement of the friction member or roll 100 with the pile of sheets in each pocket, the distance between adjacent sleeves 23 forming the pockets must be less than the arcuate distance or circular pitch between spider arms that successively sweep into the adjacent pockets. This relationship provides for a peripheral speed of the friction member greater than the speed between the pockets and the sheet withdrawing station to enable the roll 100 to engage the pile of sheets and pivot the spider arm 105 away from its stop so that the pressure of the spring 92, is applied to the sheet. For example, with a drum diameter of 51 inches and a pocket opening of 3.2 inches, and a spider 88 having about a 6 inch diameter with four equally spaced arms, the peripheral speed of the rolls 100 is almost 50 percent greater than the peripheral speed of the shelves 23 past the sheet withdrawing station.

Since the effective range of both forms of spiders is roughly ⅜ths of an inch of pile height, it is an important feature of the invention to advance the phase of the spider means with repect to the phase of the drum in response to operation of the sheet withdrawing mechanism, since such operation reduces the height of the pile of sheets as sheets are withdrawn. This phase advancing means, FIG. 7, is included in the driving connection between the shafts 35 and 54 and includes the driving wheel 51, secured to the shaft 35, and the driven wheel 53 spaced therefrom and connected together by a flexible connection. The wheels are preferably sprockets and the flexible connection illustrated is the chain 55. The chain has a length greater than that needed for merely a driving connection between the wheels and has a driven span A and a driving span B.

The spider phase advancing means includes wheels 118 and 119 shown as sprockets. The wheel or sprocket 118 is a span shortening wheel and engages the driven span A. Wheel 119 is a span lengthening wheel and engages the driving span B. Shifting the wheel 119 inwardly or to the left lengthens the driving span B and shifting the wheel 118 to the right shortens the driven span A in correspondence with the lengthening of the driving span. There are various ways of shifting these wheels. A simple form is to positively shift or move one wheel and the other wheel is shifted by being spring propelled to keep the span taut. In the construction shown, wheel 119 engaging the driving span B is positively shifted and wheel 118 engaging the driven span A is propelled by resilient means, such as a spring, although this arrangement may be reversed. The span shortening wheel is rotatably mounted on a pin 120 carried by a first wheel frame 121 which is pivoted on a pivot 122 carried by the main frame. A spring 123 having one end attached in a post 124 on the wheel frame and the other end attached in a post 125 on the main frame 21 keeps the driven span A taut and allows the same to be shortened as the driving span B is lengthened.

Figure 10:
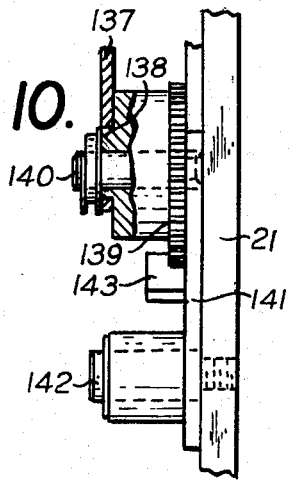
FIG. 10 is an enlarged partial section taken on line 10—10 of FIG. 7 of a ratchet cam.

The operating means to shift or move the span lengthening wheel 119 to the left, FIGS. 7 and 8, to lengthen the driving span B includes a second wheel frame 128 which is pivoted on a pivot 129 carried by the main frame. The span lengthening wheel 119 is rotatively mounted on a pin 130 carried by its wheel frame at a point spaced from the pivot 129. A circular rack or gear segment 131 is provided along an edge thereof which is engaged by a rack pinion 132 mounted on a pin 133. This rack pinion is rotated by suitable means, the means illustrated rotating the pinion intermittently although this is not necessary. This pinion is operatively connected, such as by friction connection 150, with a ratchet wheel 134. The ratchet wheel has ratchet teeth 135 in the periphery thereof. A pawl 136 carried by a pawl lever 137 engages the ratchet teeth to turn the ratchet wheel one tooth at a time. The lower end of the pawl lever is mounted on an eccentric 138, FIG. 10, carried by a pinion 139 rotatively mounted on a pin 140 carried by a lever 141. This lever is pivoted on a pin 142 carried by the main frame 21. A holding spring 143 mounted on the lever engages a tooth of the pinion 139 to retain it in rotated position but allowing rotation thereof. A lever spring 144 retains the lever 141 against a stop 145 to hold the pinion in proper position while allowing the lever to pivot the pinion away if there should be any jamming thereof. The pinion for the eccentric 138 is turned by an operating pin 146 offset from the center in the end of the third shaft 42, which shaft rotates six times for each rotation of the drum or each cycle of operation thereof. A pawl lever spring 147 retains the pawl in contact with the ratchet wheel. A spring pawl 136*a* prevents reverse turning of the ratchet wheel 134.

A cam 148 on the wheel frame 128, normally slightly spaced from the wheel frame 121, is provided to engage the wheel frame 121 to prevent any substantial movement of the frame 121 to the right that might unduly loosen the flexible connection 55 and cause it to slip a tooth.

Figures 2, 11:
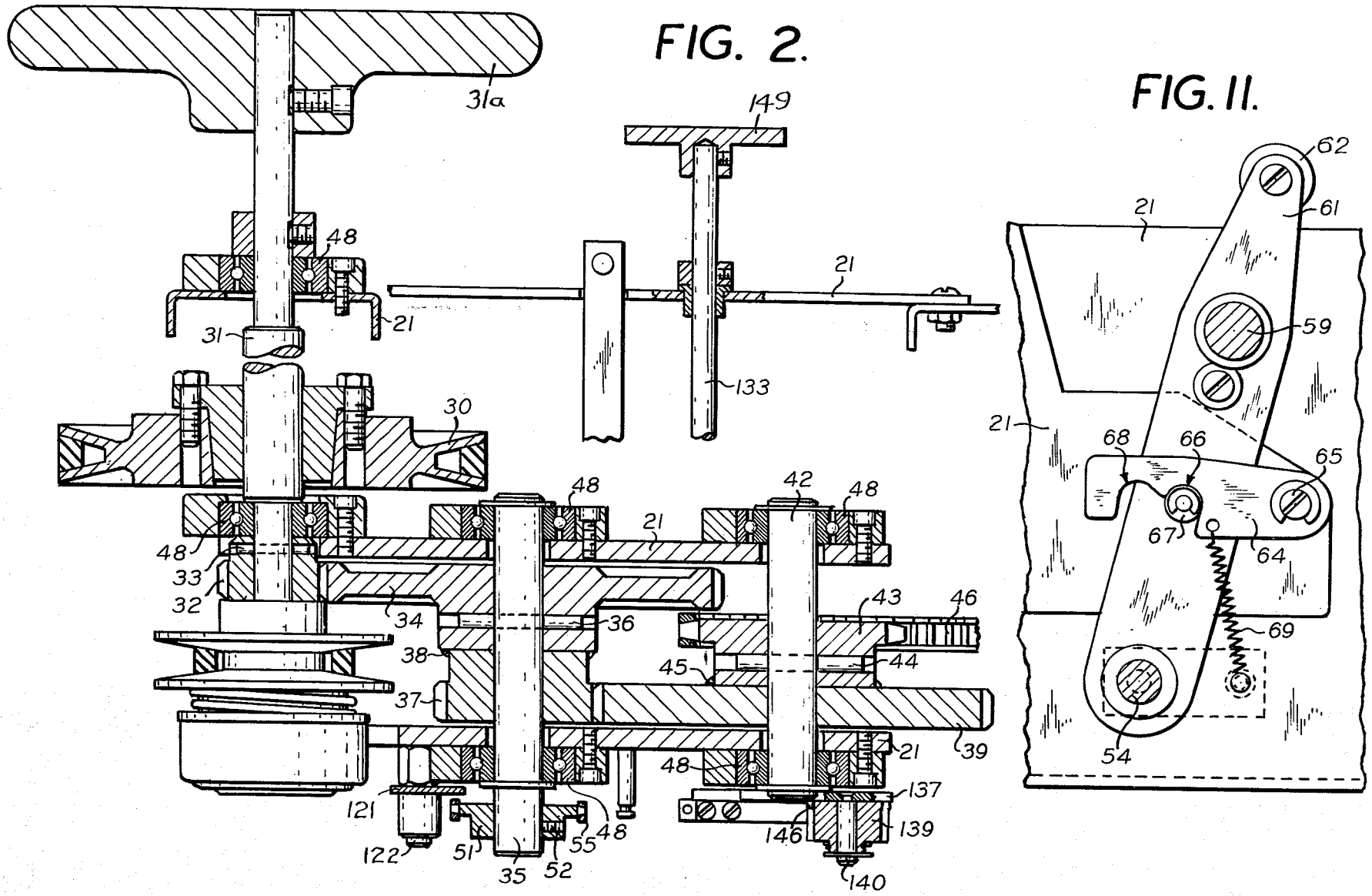
FIG. 2 is a section taken on line 2—2 of FIG. 7 through the driving mechanism for moving or rotating the collator pockets past withdrawing position and for driving the rotating spider of the sheet withdrawing mechanism.
FIG. 11 is a view taken on line 11—11 of FIG. 5 of means which allows the spider to be shifted away from the pockets.

A knob 149, FIG. 2, on the pin or shaft 133, is turned to rotate the rack pinion 132 and the rack or gear segment 131 to restore the wheel frame 128 and its span lengthening wheel 119 to initial position. A slot 128*a* in the frame 128 fits over a shouldered post 128*b*, FIG. 7. This arrangement suitably limits travel of the frame 128 in both directions. The knob 149 also enables the rack 128 to be advanced or retarded when the collator is in operation or idle, if it is deemed necessary to do so.

The operating pin 146 rotates six times for each drum cycle and engages a pinion 139 with 16 teeth so that its eccentric 138 rotates once for each 2⅔s revolutions or cycles of the drum. The sheets are often about 0.005 of an inch thick and the rotating spider roll 100 is advanced with respect to the drum about 0.013 of an inch for each advance thereof or for every 2⅔rd revolutions or repeat cycles of the drum. There is considerable latitude in the number of teeth in the pinion 139 and other elements to change the number of cycles or fractional cycles of the drum for each advance of the advancing means.

Figure 13:
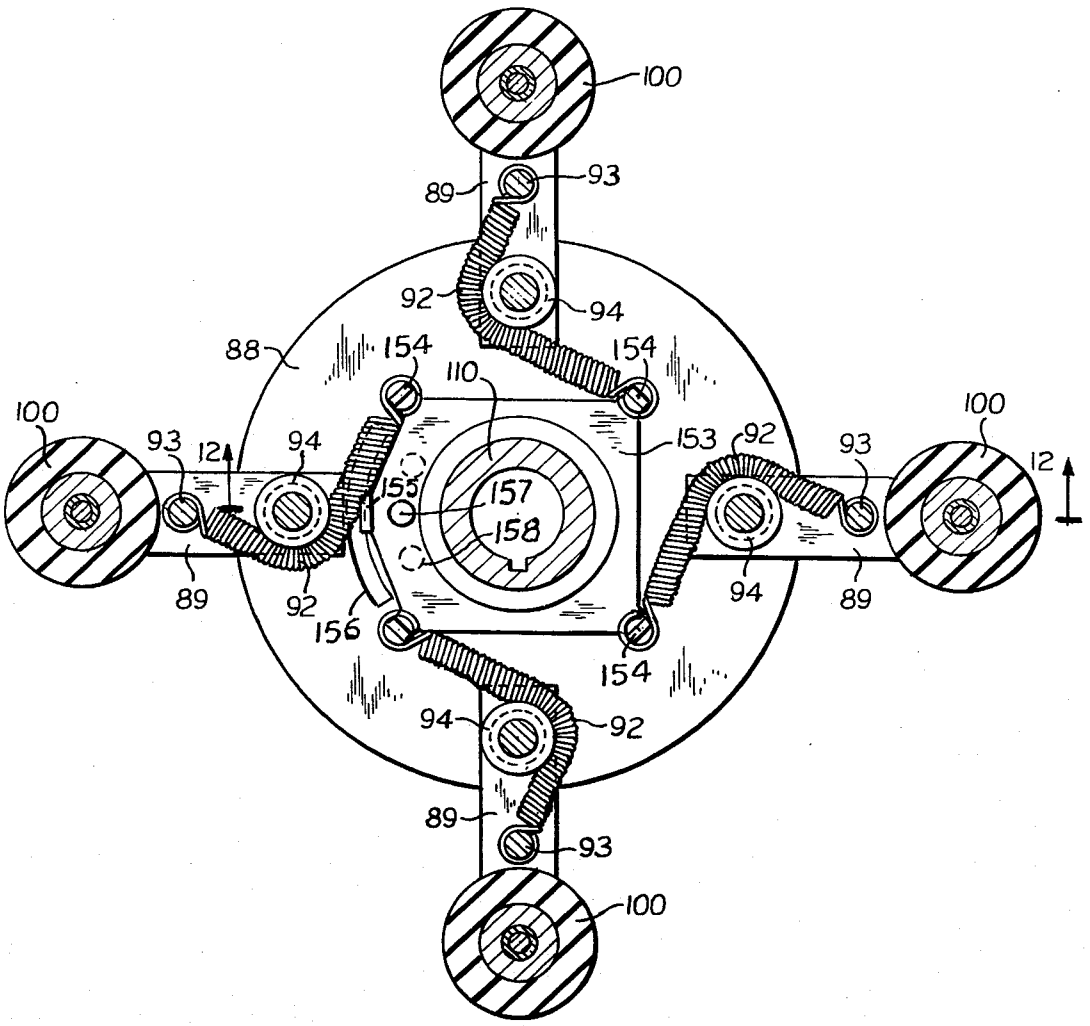
FIG. 13 is a view taken on line 13—13 of FIG. 12.
Figure 12:
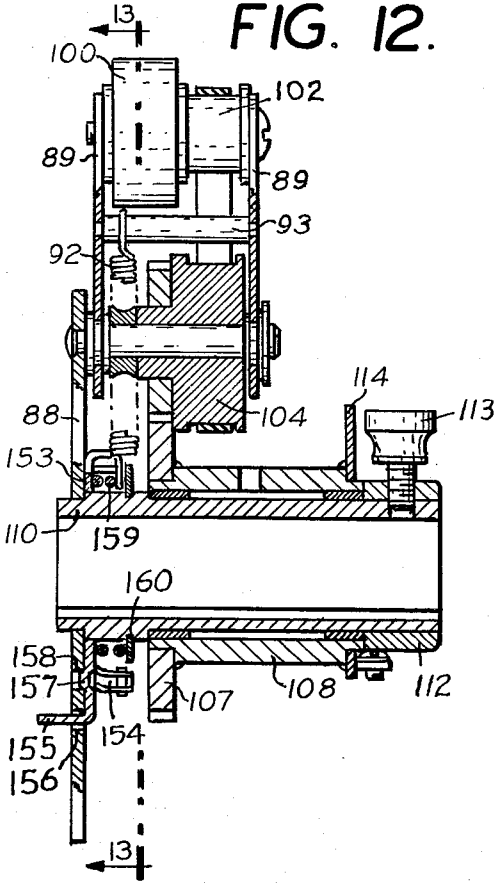
FIG. 12 is a partial section of a spider showing means for adjusting the tension of springs for the resiliently biased arms.

It is desirable that the spring tension of the springs 92 for the spider be adjustable to accommodate sheets having differing characteristics. A construction for accomplishing this is shown in FIGS. 12 and 13, which includes an adjusting plate 153 turnably mounted on the spider frame 88a and having a projection 154 for each spring. One end of each spring is attached to its respective projection. A handle 155 on the adjusting plate projects through a slot 156 in the spider frame for convenient operation. Interengaging means releasably secure the adjusting plate in adjusted position which includes a retaining projection 157 carried by one part, shown as the adjusting plate, which engages in one of the three holes 158 in the other part of the spider frame. The adjusting plate is movable axially on the spider frame with a spring 159 between the adjusting plate and a backing plate 160 to urge the adjusting plate towards the spider frame to retain the projection in one of the holes. This spring tension adjusting means may also be used with the spider 75 of FIG. 3.

The sheet withdrawing mechanism is illustrated with secondary sheet withdrawing means 25 which for relatively long sheets completes the withdrawal of the sheets from the pockets. If the sheets are short enough, the spider means alone can completely withdraw the sheets from the pockets.

A sheet withdrawing mechanism incorporating the spider 88 of FIGS. 4–6 and used with a 50 pocket drum collator has been operated at a collating speed of 50,000 sheets per hour, a speed greatly in excess of presently known collators of this type.

This invention is presented to fill a need for improvements in a sheet withdrawing mechanism for use with a collator. Various modifications in structure, in mode of operation, assembly, and manner of use may and often do occur to those skilled in the art, especially after benefiting from the teachings herein. This disclosure illustrates the preferred means of embodying the invention in useful form.

What is claimed is:

1. A sheet withdrawing mechanism for a collator having repeat cycles and a plurality of movable spaced partitions forming pockets a plurality of which each contain a pile of sheets comprising spider means to at least partially withdraw sheets from the pockets, the spider means including at least one spider, means mounting the spider means for rotation on an axis of rotation, each spider including a spider frame, arm means carried by the spider frame including at least one arm extending radially or approximately radially outwardly with respect to the axis, each arm having an inner end and an outer end, each arm projecting a substantial distance beyond the spider frame to enter between the spaced partitions of the collator far enough to at least partially withdraw a sheet from the pocket, arm pivot means spaced from and parallel to the axis of rotation and pivotally mounting the inner end of each arm on the spider frame, a stop for each arm located to limit pivoting of its arm to radial or approximately radial position with respect to the axis of the spider mounting means, arm spring means resiliently propelling each arm against its stop, a friction carried by the outer end of each arm to be projected into a pocket and rotating in one direction in the path of a circle around the axis of rotation, and the spacing between each successive friction member measured along its arc of rotation being greater than the spacing between partitions such that the friction member enters its pocket above the pile of sheets and engages the top sheet in the pile of sheets in the pocket.

2. A sheet withdrawing mechanism as in claim 1 in which the arm means includes a plurality of arms equally spaced circumferentially and the arcuate distance between the friction members is greater than the spacing between the partitions of the collator.

3. A sheet withdrawing mechanism as in claim 2 including spring adjusting means for the arm spring means, and in which the arm spring means has one end attached to its arm and passes partially around the arm pivot means and the other end is attached to the adjusting means, means mounting the adjusting means for circular adjustment on the spider frame to change the tension of the arm spring means, and means to secure the adjusting means in adjusted position.

4. A sheet withdrawing mechanism as in claim 3 in which the spring adjusting means is movable axially on the spider frame, resilient means pressing the adjusting means axially, and the means to secure the adjusting means in adjusted position includes interengaging means carried by the spider frame and the adjusting means which interengage and separate on axial movement of the adjusting means.

5. A sheet withdrawing mechanism as in claim 1 having an operative position including a mounting frame carrying the spider means, means mounting the mounting frame and spider means for movement towards and away from operative position, and means yieldably retaining the mounting frame and spider means in operative position.

6. A sheet withdrawing mechanism as in claim 5 in which the means mounting the spider mounting frame includes carrier arms, and pivot means mounting the carrier arms at a point spaced from the spider mounting means.

7. A sheet withdrawing mechanism as in claim 1 including drive mechanism operatively connnected with the spider means to rotate the latter so that each friction member has a circular speed around the axis greater than the speed of movement of the partition and in phased relation thereto so that each arm enters its respective pocket at the proper time.

8. A sheet withdrawing mechanism as in claim 7 in which the path of the circular rotation of each friction member provides a periphery for the spider means including in combination a secondary sheet withdrawing mechanism positioned adjacent to the periphery of the spider means to receive and transport the sheets withdrawn from the pockets.

9. A sheet withdrawing mechanism as in claim 7 in which the drive mechanism includes a driven wheel connected with the spider means and a driving wheel spaced from the driven wheel, and spider advancing means connected between the driving wheel and the driven wheel to advance the driven wheel relatively to the driving wheel whereby the phase or relative position of the spider means and each arm is advanced with respect to the pockets.

10. A sheet withdrawing mechanism as in claim 9 including operating means connecting the drive mechanism with the spider advancing means to operate the latter.

11. A sheet withdrawing mechanism as in claim 10 in which the operating means operates intermittantly to actuate the spider advancing means.

12. A sheet withdrawing mechanism as in claim 9 in which the spider advancing means includes a flexible connection operatively connecting the driving wheel and the driven wheel together and having a driven span and a driving span between the wheels, the flexible connection having a length in excess of that required for a driving connection between the driving and driven wheels, the spider advancing means including a span lengthening wheel engaging the driving span, a span shortening wheel engaging the driven span, wheel mounting means mounting the span lengthening wheel and the span shortening wheel, and operating means operatively connected with the wheel mounting means to move the span lengthening wheel and the span shortening wheel to lengthen the driving span and shorten the driven span.

13. A sheet withdrawing mechanism as in claim 12 in which the wheel mounting means includes a first wheel frame mounting the span shortening wheel, a second wheel frame mounting the span lengthening wheel, operating means operatively connected with one wheel frame to move the same and its wheel to change the length of its span of the flexible connection, and resilient means propelling the other wheel frame to retain its wheel in contact with its span of the flexible connection and keep the spans taut.

14. A sheet withdrawing mechanism as in claim 13 in which the operating means operates intermittantly to move the wheel frame at desired intervals of the cycle or cycles of the collator.

15. A sheet withdrawing mechanism as in claim 13 in which the operating means is connected with the second wheel frame to move the span lengthening wheel.

16. A sheet withdrawing mechanism as in claim 15 including cam means carried by the second wheel frame and located in abutting relation to the first wheel frame.

17. A sheet withdrawing mechanism as in claim 13 including cam means carried by one wheel frame and located in abutting relation to the other wheel frame.

18. The combination of a collator with the sheet withdrawing mechanism of claim 7 including a plurality of spaced partitions forming pockets, means mounting the partitions for movement successively adjacent to the sheet withdrawing mechanism so that each arm of the spider means with its friction member projects into successive pockets and the friction member engages the top sheet therein to withdraw the same, and the driving mechanism being operatively connected with the collator to move the partitions in timed relation with the rotation of the spider means so that each arm enters its respective pocket at the proper time.

19. The combination of a collator with the sheet withdrawing mechanism as defined in claim 18 including secondary sheet withdrawing mechanism adjacent to the spider means to receive and transport the sheets withdrawn from the pockets.

20. A combination of a collator with the sheet withdrawing mechanism as defined in claim 18 including a mounting frame carrying the spider means, means mounting the mounting frame and the spider means for movement towards and away from an operative position adjacent to the pockets, and means yieldably retaining the mounting frame and spider means in operative position.

21. A combination of a collator with the sheet withdrawing mechanism as defined in claim 18 in which the arm means includes a plurality of arms equally spaced circumferentially and the arcuate distance between the friction members is greater than the spacing between the partitions of the collator.

22. The combination of a collator with the sheet withdrawing mechanism as defined in claim 21 including secondary sheet withdrawing mechanism adjacent to the spider means to receive and transport the sheets withdrawn from the pockets; the drive mechanism including a driven wheel operatively connected with the spider means, a driving wheel spaced from the driven wheel, and spider advancing means connected between the driving and driven wheels to advance the phase of the spider means with respect to the collator partitions.

23. A combination of a collator with the sheet withdrawing mechanism as defined in claim 18 in which the driving mechanism includes a driven wheel operatively connected with the spider means, a driving wheel spaced from the driven wheel, and spider advancing means connected between the driving and driven wheels to advance the phase of the spider means with respect to the collator partitions.

24. A combination of a collator with the sheet withdrawing mechanism as defined in claim 18 in which the partitions are mounted on a drum, and means rotatively mounting the drum.

25. A combination of a collator with the sheet withdrawing mechanism as defined in claim 18 in which the friction member on the end of each arm is a roll, means rotatably mounting each roll on its arm, and means operatively connected with the roll to rotate the same in the direction of rotation of the spider means to at least partially withdraw the top sheet from the pile of sheets in the pocket by combined rotation and sweep of the roll.

26. A combination of a collator with the sheet withdrawing mechanism as defined in claim 25 including secondary sheet withdrawing mechanism adjacent to the spider means to receive and transport the sheets withdrawn from the pockets.

28. A combination of a collator with the sheet withdrawing mechanism as defined in claim 25 in which the arm means includes a plurality of arms equally spaced circumferencially and the arcuate distance between the friction members is greater than the spacing between the partitions of the collator.

27. A combination of a collator with the sheet withdrawing mechanism as defined in claim 25 including a mounting frame carrying the spider means, means mounting the mounting frame and the spider means for movement towards and away from an operative position adjacent to the pockets, and means yieldably retaining the mounting frame and spider means in operative position.

29. A combination of a collator with the sheet withdrawing mechanism as defined in claim 28 including secondary sheet withdrawing mechanism adjacent to the spider means to receive and transport the sheet withdrawn from the pockets; the drive mechanism including a driven wheel operatively connected with the spider means, a driving wheel spaced from the driven wheel, and spider advancing means connected between the driving and driven wheels to advance the phase of the spider means with respect to the collator partitions.

30. A combination of a collator with the sheet withdrawing mechanism as defined in claim 25 in which the driving mechanism includes a driven wheel operatively connected with the spider means, a driving wheel spaced from the driven wheel, and spider advancing means connected between the driving and driven wheels to advance the phase of the spider means with respect to the collator partitions.

31. A combination of a collator with the sheet withdrawing mechanism as defined in claim 25 in which the partitions are mounted on a drum, and means rotatively mounting the drum.

32. A combination of a collator with the sheet withdrawing mechanism as defined in claim 18 in which the arm means includes a plurality of arms equally spaced circumferentially and the arcuate distance between the friction members being greater than the spacing between the partitions of the collator, and each friction member being a fixed or semi-fixed roll to at least partially withdraw the top sheet in the pile solely by the sweeping movement of the friction member as the spider means rotates.

33. A sheet withdrawing mechanism as in claim 1 in which the arm spring means has ends with one end attached to its arm spaced from the arm pivot means and passes partially around the arm pivot means and the other end is anchored to the spider frame at a point spaced from the arm pivot means.

34. A sheet withdrawing mechanism as in claim 1 in which each friction member is a fixed roll, or a semi-fixed roll so as to be rotatable in one direction, on the outer end of its arm to at least partially withdraw the top sheet in the pile solely by the sweeping movement of the friction member as the spider means rotates, and the direction in which the semi-fixed roll is rotatable being the same as that of the spider means.

35. A sheet withdrawing mechanism as in claim 1 in which each friction member is a roll, means rotatably mounting the roll on the outer end of its arm, and means operatively connected with the roll to rotate the same in the same direction as the rotation of the spider means to at least partially withdraw the top sheet from the pile of sheets in the pocket by combined rotation and sweep of the roll.

36. A sheet withdrawing mechanism as in claim 35 including drive mechanism for rotating the spider means having a driven wheel operatively connected with the spider means, a driving wheel spaced from the driven wheel, and spider advancing means connected between the driving wheel and the driven wheel.

37. A sheet withdrawing mechanism as in claim 35 in which the means to rotate the roll includes a roll driven pulley secured to the roll, a roll driving pulley rotatively mounted on the arm pivot means, a belt connection connecting the driving and driven pulleys, and means operatively connected with the roll driving pulley to rotate the same.

38. A sheet withdrawing mechanism as in claim 34 in which the means to rotate the roll driving pulley includes a driven gear secured to the roll driving pulley, and a fixed gear mounted on the spider frame and meshing with the driven gear.

39. A sheet withdrawing mechanism as in claim 38 including a sleeve mounted on the spider frame, the fixed gear being secured to the sleeve, and a holding bracket secured to the sleeve and adapted to be anchored to adjacent structure.

40. A sheet withdrawing mechanism as in claim 39 including driving mechanism having a driven wheel operatively connected with the spider means, a driving wheel spaced from the driven wheel, and spider advancing means connected the driving wheel and the driven wheel to advance the phase of the latter with respect to the driving wheel and thereby advance the phase of the spider means with respect to the pockets of the collator so that each arm enters its respective pocket at the proper time.

41. A sheet withdrawing mechanism as in claim 35 including a fixed gear mounted on the spider frame, and a driving connection between the fixed gear and the roll to rotate the latter.

* * * * *